US005649598A

United States Patent [19]

MacDonald, III

[11] Patent Number: 5,649,598

[45] Date of Patent: Jul. 22, 1997

[54] CORROSION SENSING SPRINKLER SHROUD

[75] Inventor: Norman J. MacDonald, III, Lunenburg, Mass.

[73] Assignee: PNM, Inc., Boxboro, Mass.

[21] Appl. No.: 670,183

[22] Filed: Jun. 20, 1996

[51] Int. Cl.[6] ..... A62C 35/68

[52] U.S. Cl. ..... 169/54; 169/16; 169/37

[58] Field of Search ..... 169/16, 37, 54

[56] References Cited

U.S. PATENT DOCUMENTS

| | | | |
|---|---|---|---|
| 676,221 | 8/1901 | Davis | 169/37 |
| 2,890,758 | 6/1959 | Pfalzgraff et al. | 169/37 |
| 3,388,747 | 6/1968 | Hodnett | 169/39 |
| 3,727,695 | 4/1973 | Danton | 169/37 |
| 4,706,759 | 11/1987 | Grasseschi | 169/51 |
| 4,964,470 | 10/1990 | Gaulin | 169/56 |
| 4,964,471 | 10/1990 | Michalik et al. | 169/37 |

*Primary Examiner*—Gary C. Hoge
*Attorney, Agent, or Firm*—Morse, Altman & Benson

[57] ABSTRACT

A shroud for use with a sprinkler assembly in a corrosive environment comprising a secondary bag surrounding the sprinkler head to protect it from the corrosive environment for a minimum period of time, a ribbon-shaped corrosion sensor located adjacent to the outer surface of the secondary bag that corrodes apart to electrically trigger an alarm before the ability of the secondary bag to protect the sprinkler head fails, a primary bag surrounding the secondary bag and the sensor to protect them from the corrosive environment for a minimum period of time, a pair of gaskets with an opening for the sprinkler head, the bags extending through the opening of one of the gaskets and annular skirts extending from the edge of the bag openings being sandwiched between the gaskets and held together by a pressure-sensitive adhesive, the bags melting at a temperature that is higher than the normal temperature of the corrosive environment and lower than the temperature at which the sprinkler head activates.

27 Claims, 5 Drawing Sheets

CORROSION SENSING SPRINKLER SHROUD

BACKGROUND OF THE INVENTION

1. Field of the Invention

The present invention relates to sprinkler assemblies for corrosive environments, more specifically, to a shroud that covers the sprinkler head element of the sprinkler assembly in order to protect the element from the corrosive gases and vapors in the environment and that can post a notification when the shroud needs to be replaced.

2. The Prior Art

Industrial plants generate unwanted and undesirable byproducts, including noxious, flammable, and corrosive vapors and gases. These vapors and gases must be removed from the premises, preferably at the rate that they are generated. Ductworks, known as scrubber ducts, operating at negative pressures are designed to do so. Since these scrubber ducts frequently carry vapors and gases which are pyrophoric and highly volatile, they are required to be outfitted with sprinklers. The heat-sensitive head of a sprinkler assembly operating in such a corrosive environment must be protected from the gases and vapors of that environment. In the sprinkler heads of the prior art, such as that shown in U.S. Pat. No. 4,964,470, issued to Gaulin on Oct. 23, 1990 and entitled SPRINKLER CONNECT TO SCRUBBER DUCT, a shroud in the shape of a bag surrounds the sprinkler head to protect it from the environment. The nature of the shroud is such that it melts at a temperature that is higher than the normal temperature of the environment but lower than the operating temperature of the sprinkler head so that the sprinkler head is exposed for operation.

The shrouds, which are typically composed of polyethylene or polypropylene, are somewhat sensitive to the corrosive gases. As a result, they eventually break down, leaving the sprinkler head exposed to the corrosive effects of the gases. Thus, in order to maintain a properly operating sprinkler system, the shrouds must be visually inspected periodically and replaced when they are no longer able to protect the sprinkler head. For example, in the typical semiconductor fabrication facility, the average shroud is effective for about one year. In order to maintain a reasonable margin of safety, these sprinkler heads are inspected twice a year. However, certain sprinklers are exposed to much higher concentrations of corrosive gases than the average and, in extreme cases, only last for about a week. Obviously, these sprinklers must be inspected much more often.

In the case of the sprinkler heads of the Gaulin patent, each sprinkler head must be manually removed from the scrubber duct for inspection or, in the case of other sprinkler systems, the entire scrubber duct system must be shut down to manually inspect the sprinkler heads. Such periodic inspections are costly in terms of time and labor and, if the scrubber duct system must be shut down, costly in terms of lost production. Thus, there is an ongoing need for an alternative to periodic visual inspections of each sprinkler head of the system so that the costs associated with maintaining the proper operation of these sprinkler systems is minimized.

SUMMARY OF THE INVENTION

It is a principle object of the present invention is to provide an apparatus for automatically detecting the approaching failure of a sprinkler head's shroud.

It is a further object of the present invention eliminate a substantial percentage of the manual visual safety inspections necessary for proper operation of the sprinkler heads in a sprinkler system.

The sprinkler shroud of the present invention is designed for use in a sprinkler system that detects and extinguishes fires in an environment where corrosive and/or flammable gases and vapors are present. A hydraulic supply grid supplies fluid to a sprinkler assembly mounted in an opening in a scrubber duct, where the sprinkler assembly includes a sprinkler head. The typical sprinkler head blocks the fluid until it detects a predetermined elevated temperature, at which time the sprinkler head disperses the fluid in order to extinguish the fire. The sprinkler assembly is typically mounted in the duct opening by a plurality of bolts extending from a mounting block permanently attached to the duct into holes in a mounting plate to which the sprinkler head is attached. The bolts are secured by nuts.

The preferred sprinkler shroud includes a secondary bag, a primary bag, a lower gasket, an upper gasket, and a corrosion sensor. The secondary bag surrounds and protects the sprinkler head, the corrosion sensor is located outside the secondary bag, and the primary bag surrounds and protects the secondary bag and the corrosion sensor. The gaskets provide a seal between the duct wall and the sprinkler assembly.

The secondary bag size is determined by the size of the sprinkler head. An annular skirt extends outwardly from the entire edge of the bag opening for mounting. Preferably, the primary bag is approximately the same size as the secondary bag.

The bags are composed of a material suitable to the corrosive environment, where the material selection parameters include its melting point and its resistance to the effects of the corrosive gases present. The bags must melt at a temperature lower than the activation temperature of the sprinkler head, otherwise the dispersion of the fluid will be obstructed by the bags. However, the melting point cannot be so low that the bags melts at the normal temperature of the environment. In addition, the material must be able to resist the effects of the environment for at least a predetermined minimum period of time based upon the expected concentration of corrosive gases in the environment. The preferred bag materials are polyethylene and polypropylene.

Preferably, the bags are mounted to the sprinkler assembly by a pair of gaskets. Each gasket has a hole approximately the same size and shape as the bag openings and, preferably, a plurality of mounting holes. The mounting holes are located so that they are aligned with the mounting bolts of the sprinkler assembly so that those bolts can also secure the shroud. Preferably, the gaskets are composed of an ethylene propylene diene monomer (EPDM).

The corrosion sensor detects when the primary bag has been breached by the corrosive gases. The condition of the sensor is determined by detecting any interruption of an electrical signal passing through the sensor, which then triggers an alarm. Thus, the sensor must be more easily corroded by the corrosive gases than the secondary bag and must be able to conduct electricity with little electrical resistance. For the typical environment in which the shroud must operate, the preferred materials for the sensor are copper and aluminum and has a thickness in the range of from 1 mil to 100 mils.

The sensor must not interfere with the dispersion of the liquid if the sprinkler head is activated by heat or fire. Because the preferred material of the sensor will not melt at a temperature below that of the activation temperature of the sprinkler head, the preferred sensor has a small horizontal surface area. The width of the sensor is on the order of approximately 3/16 inch.

The preferred shroud is assembled by first coating the upper surface of the lower gasket with an adhesive and inserting the primary bag through the lower gasket bag hole such that primary bag skirt rests on the adhesive. The sensor is formed into a U shape and inserted into the primary bag such that the ends of the corrosion sensor extend beyond the edge of the lower gasket. The upper surface of the primary bag skirt is coated with an adhesive and the secondary bag is inserted into the primary bag until the secondary bag skirt rests on the primary bag skirt. The upper surface of the secondary bag skirt is coated with an adhesive and the upper gasket is placed on top of the secondary bag skirt such that the gasket bag holes and the gasket mounting holes are aligned. The adhesive on the lower gasket secure the gaskets together when the shroud is mounted to the sprinkler assembly. The gaskets form a substantially gas- and vapor-tight seal between the mounting plate and mounting block.

BRIEF DESCRIPTION OF THE DRAWINGS

For a fuller understanding of the nature and object of the present invention, reference is made to the accompanying drawings, wherein.

DETAILED DESCRIPTION

Figure 1:
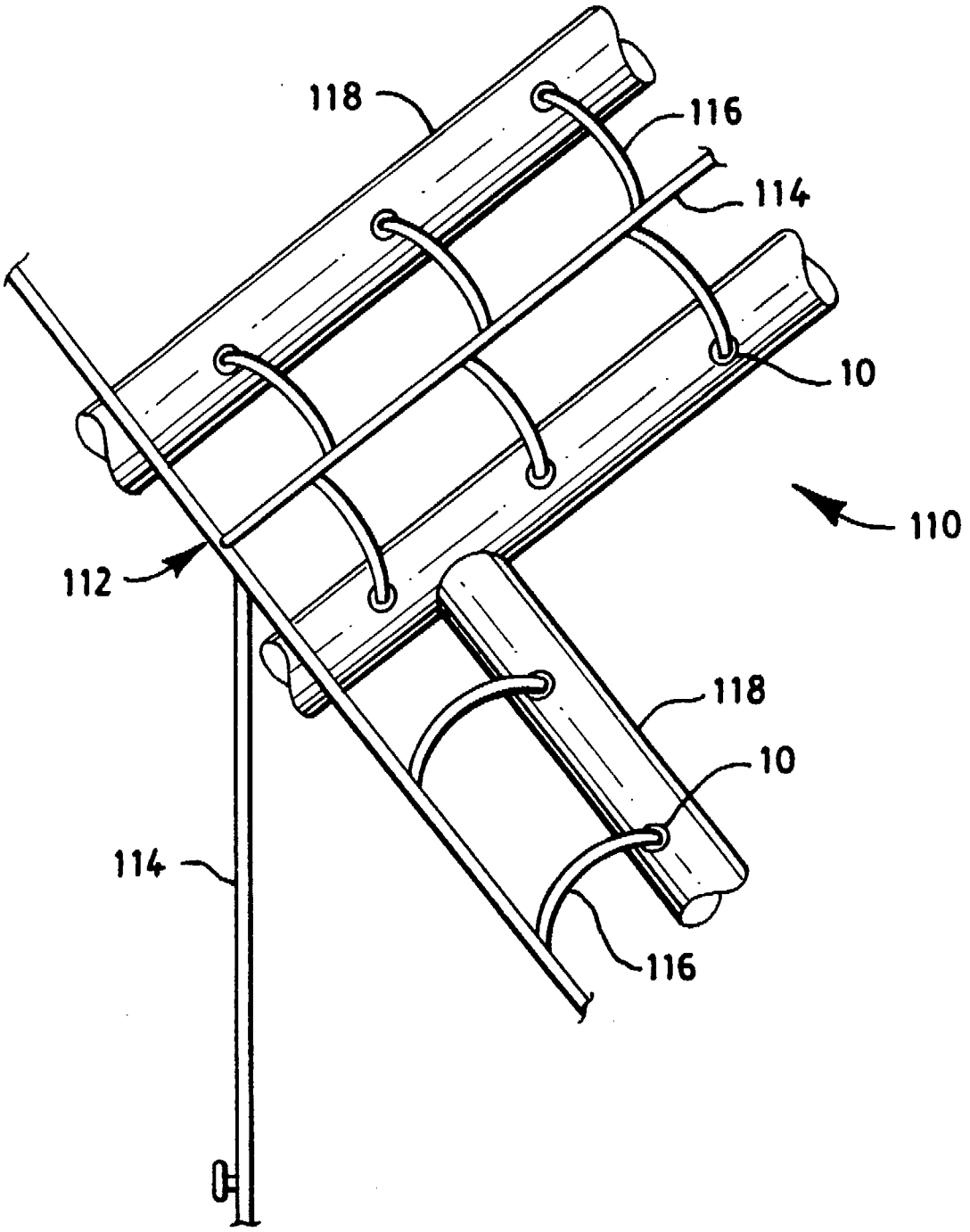
FIG. 1 PRIOR ART
FIG. 1 is a top perspective view of a typical sprinkler system with which the present invention is used.
Figure 2:
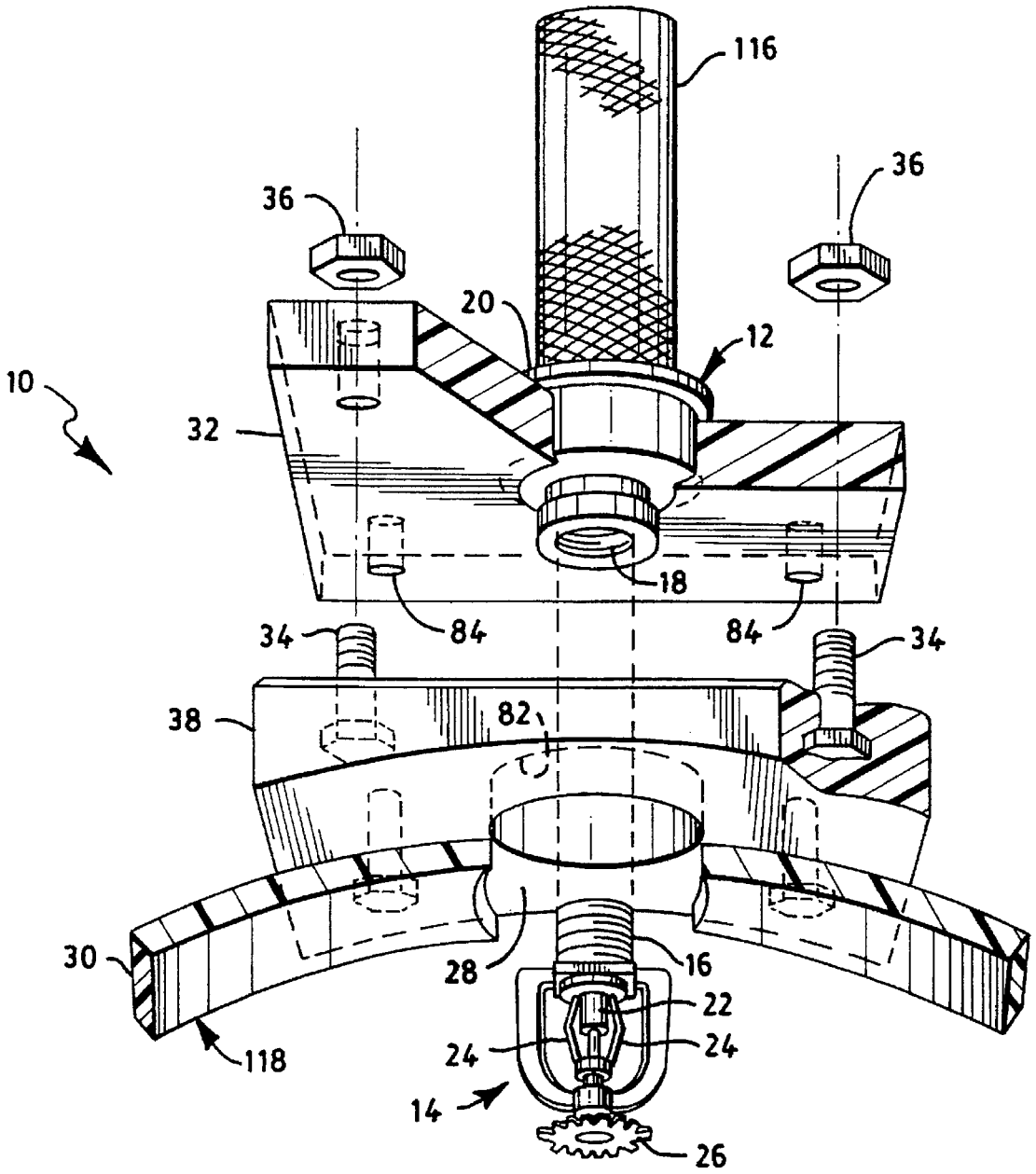
FIG. 2 PRIOR ART
FIG. 2 is a partially exploded, perspective view of a typical sprinkler assembly with which the present invention is used.

The sprinkler shroud of the present invention is designed for use in a sprinkler system that detects and extinguishes fires in an environment where corrosive and/or flammable gases and vapors are present. An example of such a sprinkler system 110 is shown in FIG. 1 and includes a rigid, stationary hydraulic supply grid 112 comprising a plurality of rigidly supported, interconnected pipes 114, and a plurality of sprinkler arms 116 connected to the hydraulic supply grid 112. The hydraulic fluid is typically water, but any fluid appropriate to extinguish a fire of the corrosive gases present may be used. Each sprinkler arm 116 connects to a sprinkler assembly 10 mounted to a scrubber duct 118, an example of which is shown in FIG. 2 and includes a fitting 12 and a sprinkler head 14. The sprinkler head 14 is a typical prior art, temperature-sensitive sprinkler head that is provided with a length of pipe 16, the outer surface of which is threaded for turning into an internal thread at one end of the fitting 18. The other end of the fitting 20 is connected to a pressurized supply of water or other liquid appropriate for dousing a fire within the environment. The pipe 16 is blocked by a central plug 22 held in place by a pair of flexible links 24 that are designed to melt at a predetermined elevated temperature, typically between from 165° F. to 212° F. When, due to heat and/or fire, the links 24 do melt, the plug 22 is dislodged from the pipe 16 by the force of the liquid acting against it. The liquid is dispersed over a large area by a dispersion device 26.

The sprinkler assembly 10 is mounted in an opening 28 in the scrubber duct wall 30 so that the sprinkler head 14 extends into the corrosive environment. The manner in which the sprinkler assembly 10 is mounted is not an essential aspect of the present invention and a variety of mounting schemes are contemplated, an example of which is shown. The fitting 12 is seated in a mounting plate 32 that is held by a plurality of bolts 34 and nuts 36 to a mounting block 38 that is permanently bonded to the wall 30. The bolts 34 extend upward from the mounting block 38 and into mounting holes 84 in the mounting plate 32 as the sprinkler head 14 extends through an opening 82 in the mounting block 38. The nuts 36 secure the mounting plate 32 to the mounting block 38. In an alternate arrangement, the bolts extend through holes directly in the duct wall and the bottom surface of the mounting plate is contoured to fit the outer surface of the wall.

Figure 3:
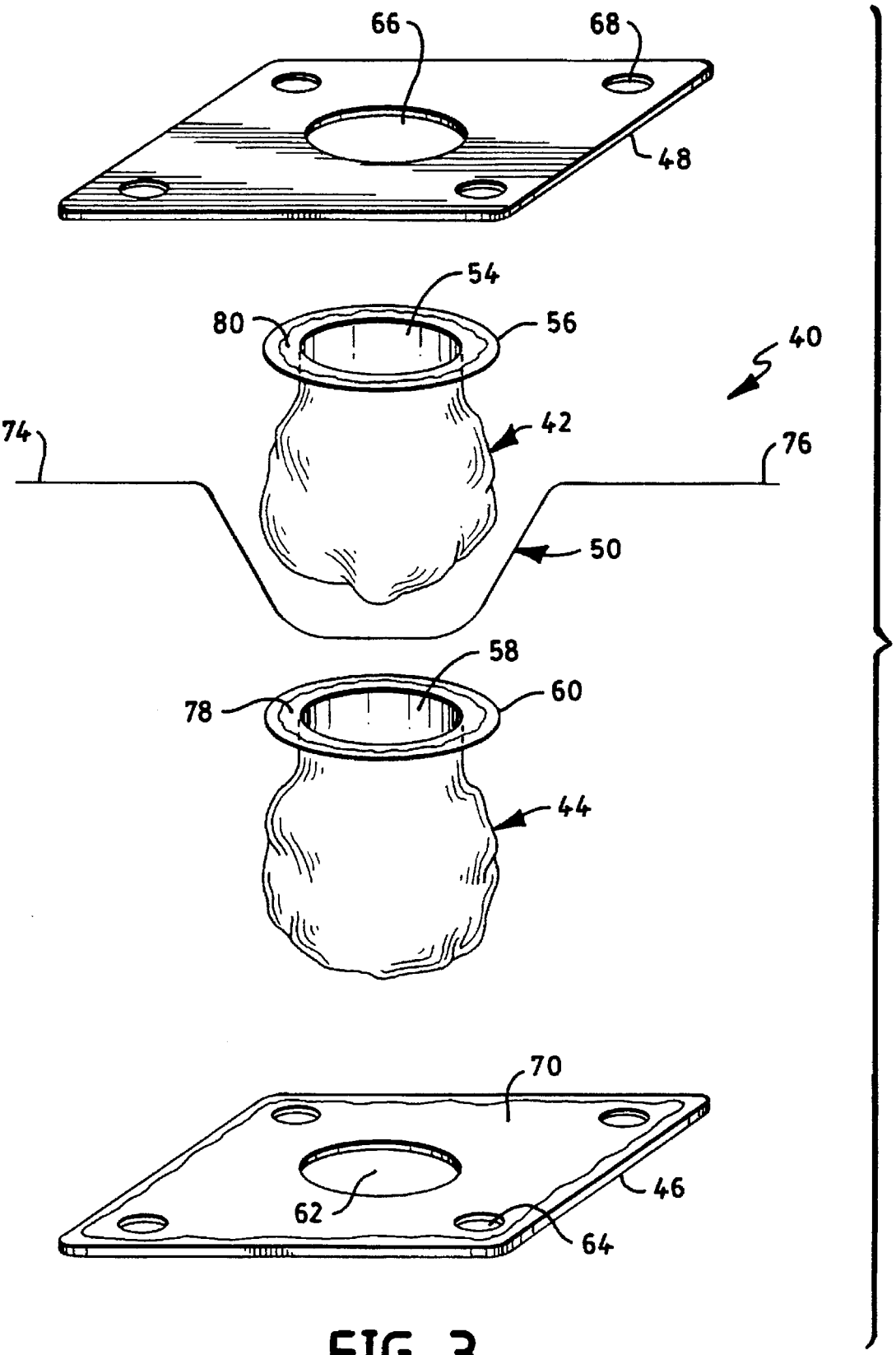
FIG. 3 is an exploded, perspective view of the preferred embodiment of the present invention.

A preferred embodiment of the sprinkler shroud of the present invention is shown in FIG. 3. The shroud 40 includes five components: a secondary bag 42, a primary bag 44, a lower gasket 46, an upper gasket 48, and a corrosion sensor 50. The primary bag 44 is the main source of protection and the secondary bag 42 is the secondary source, taking over when the primary bag 44 is breached by the corrosive gases. The corrosion sensor 50 detects when the primary bag is breached. The gaskets 46, 48 provide a seal between the scrubber duct wall 30 and the sprinkler assembly 10.

The size of the secondary bag 42 is determined by the size of the sprinkler head 14 that it protects. An annular, planar skirt 56 extends outwardly from the entire edge of the secondary bag opening 54. When used with the typical sprinkler assembly 10, the preferred skirt 56 extends outwardly and approximately perpendicularly from the edge of the opening 54. A secondary bag 42 for use with the typical sprinkler assembly 10 has a width of about 3¼ inches and a height of about 4¼ inches.

The material of which the secondary bag 42 is composed and its thickness must be suitable to the corrosive environment in which it must operate. The parameters for selecting the material include its melting point and its resistance to the effects of the corrosive gases and vapors in the environment. The melting point of the material must be selected so that the secondary bag 42 substantially completely melts before the sprinkler head activates by heat or fire, which is typically in the range of from 165° F. to 212° F. and occasionally higher, otherwise the dispersion of the sprinkler fluid will be obstructed by the secondary bag 42, reducing the sprinkler's effectiveness. However, the melting point cannot be so low that the primary bag 44 melts when there is no fire. In other words, the normal temperature of the environment must be a consideration. The resistance of the material to the environment should be as great as is practical while retaining the necessary melting point. The material must be able to resist the effects of the environment for at least a predetermined minimum period of time based upon the expected concentration of corrosive gases in the environment.

For most purposes, the preferred bag materials are polyethylene and polypropylene. Of the two materials, polypropylene has a higher resistance to the corrosion than polyethylene, but also has a higher melting point, typically about 200° F. compared to about 135° F. for polyethylene. The preferred thickness of the secondary bag 42 for most purposes is approximately 4/1000 inch (4 mils).

In the preferred embodiment, the primary bag 44 is substantially identical to the secondary bag 42 in size and composition. This allows for a more efficient manufacturing process. The secondary bag 42 will fit inside the primary bag 44 because the thickness of the bags 42, 44 is such that they are extremely flexible. Optionally, the primary bag 44 is larger than the secondary bag 42 when it is necessary to ease the manufacture of the shroud 40.

In this preferred embodiment, the bags 42, 44 are mounted to the sprinkler assembly by the lower gasket 46 and the upper gasket 48. While a specific size and shape for the gaskets 46, 48 is not essential to the proper functioning of the shroud 40, each gasket 46, 48 must have enough surface area to include a bag hole 62 and a plurality of mounting holes 64. For reasons discussed below, the gaskets 46, 48 are preferably substantially the same size and shape. Examples of a lower gasket 46 and an upper gasket 48 are shown in FIG. 3. Preferably, the outline of the gaskets 46, 48 matches the outline of the sprinkler assembly mounting plate 32 which, in this case, is approximately rectangular. The shape of the bag hole 62, 66 approximately matches the shape of the bag opening 54, 58 and is approximately the same size as the wall opening 28 through which the sprinkler head 14 extends. The mounting holes 64, 68 are sized and located so that the sprinkler assembly mounting bolts 34 and nuts 36 also secure the shroud 40. Thus, the size and shape of the mounting holes 64, 68 are dependent upon the sprinkler assembly 10 with which the shroud 40 is used. During the shroud assembly process, described in detail below, the mounting holes 64, 68 are aligned between the lower gasket 46 and upper gasket 48 so that the sprinkler assembly mounting bolts 34 and nuts 36 secure both gaskets 46, 48 in the same manner. Because the bag holes 62, 66 and mounting holes 64, 68 are aligned between the gaskets 46, 48 and in order to maintain an efficient manufacturing process, the gaskets 46, 48 are preferably the same size and shape.

In an alternate embodiment, the gaskets do not have mounting holes, but are held in place only by the pressure exerted between the mounting plate and the mounting block by the bolt/nut combinations. In this embodiment, the gaskets only need to have the same surface area as the bag skirts.

The material from which the gaskets 46, 48 are composed and thickness of the gaskets 46, 48 depend upon the environment in which they must operate. In the preferred embodiment, the gaskets 46, 48 are composed of an ethylene propylene diene monomer (EPDM) and are approximately 1/32 inch thick.

The purpose of the corrosion sensor 50, an essential element of the present invention, is to detect when the primary bag 44 has corroded to the point that it is breached, allowing the corrosive gases to attack the secondary bag 42. Thus, the corrosion sensor 72 is located between the two bags 42, 44, and at least a portion of the corrosion sensor 50 must be more easily corroded by the corrosive gases than the secondary bag 42. The difference in corrosion resistance must be such that the corrosion sensor 50 warns of a breach of the primary bag 44 far enough in advance of a breach of the secondary bag 42 to allow the shroud 40 to be replaced within a reasonable period of time, ranging from several hours to several days, depending upon the corrosiveness of the environment.

In the preferred embodiment, the condition of the corrosion sensor 50 is detected by passing an electrical signal through it and detecting any interruption of the signal, which triggers an alarm 90 indicating that the shroud 40 needs to be replaced. An example detection circuit is shown schematically in FIG. 4. When the corrosion sensor 50 is corroded to the point that it can no longer conduct electricity, the corrosion sensor 50 separates, causing the transistor 92 to saturate via resistor 98, thereby energizing the relay 94. The energized relay 94 supplies power to the alarm 90 and to latch the relay 94 on. This latter feature is necessary because the corroded ends of the corrosion sensor 50 are still in very close proximity and the motion of the corrosive gases may cause the separated ends to touch, turning off the transistor and, thereby, turning off the alarm 90. Latching the relay 94 will maintain the alarm 90 on even if the separated ends touch.

Figure 4:
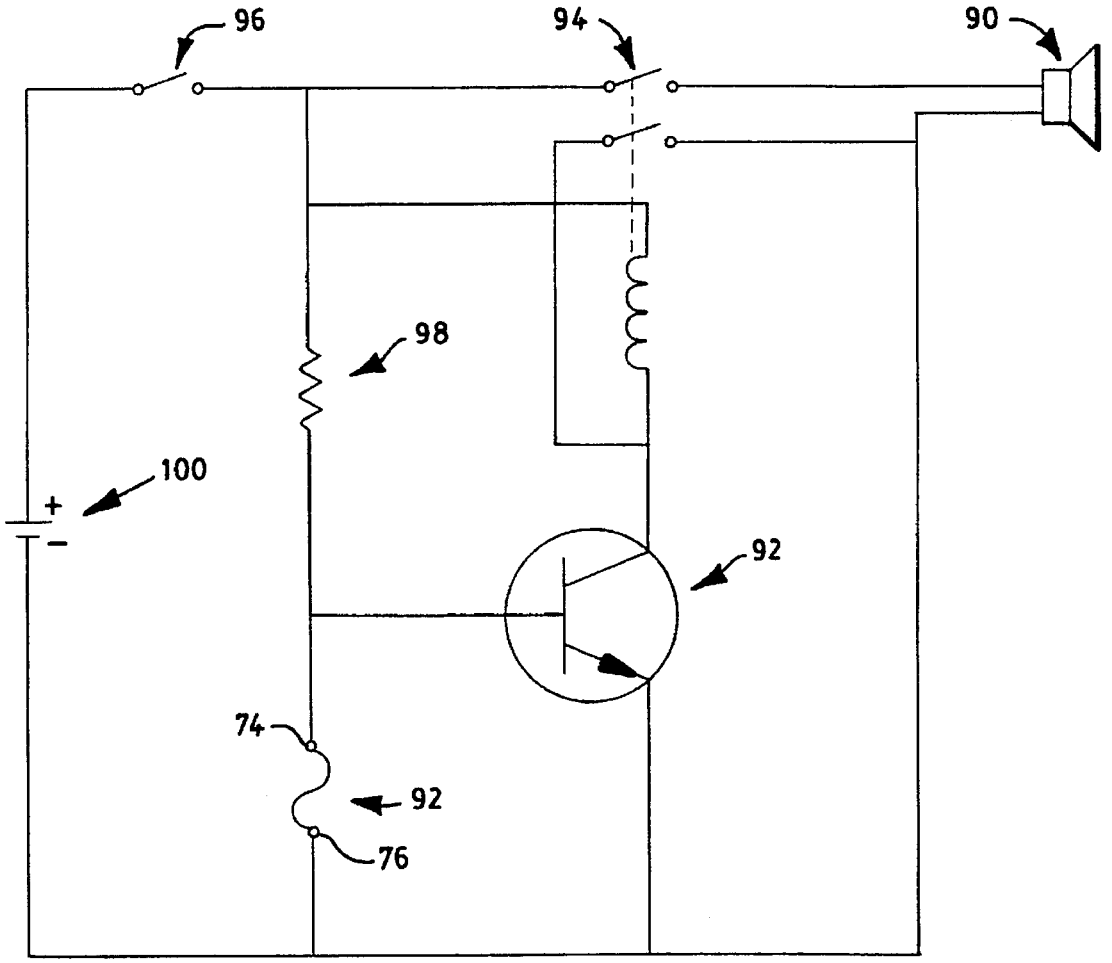
FIG. 4 is a schematic diagram of a detection and alarm circuit.

The circuit is powered by power source 100, shown in FIG. 4 as a battery. In a typical installation, the power source will be derived from the main building power. A power switch 96 controls power to the detection circuit and is used to turn off the alarm 90 after it has been latched on.

In order to be able to replace the shroud 40, the corrosion sensor 50 must be removably connected to the detection circuit. One way to accomplish this is by providing the ends of the wires from the detection circuit with electrical connectors in the form of spring clips. Each clip is opened by pressing one side, inserting the corrosion sensor end 74, 76, and releasing the clip. The corrosion sensor end 74, 76 is pinched between two edges, forming a electrical contact adequate for the operation of the detection circuit.

The circuit of FIG. 4 shows only one corrosion sensor 50. However, in the typical manufacturing facility where the present invention is used, there may be dozens or even hundreds of sprinkler heads with shrouds. Several arrangements are possible for large numbers of the shrouds, two examples of which are described. In one arrangement, each shroud has its own alarm circuit so that the exact shroud that must be replaced is indicated. In another arrangement, several shrouds are connected in series to one alarm. Preferably, these shrouds are in close proximity to each other so that if the alarm sounds, the location of the failing shroud is known within a small area.

Thus, the material of which the corrosion sensor 50 is composed must be selected to be more susceptible to corrosion than the secondary bag 42 in the environment in which both must operate and must be able to conduct electricity with little electrical resistance. For the typical environment in which the shroud 40 must operate, the preferred materials for the corrosion sensor 50 are copper and aluminum.

The preferred corrosion sensor 50 is a ribbon of the selected material. The main factor in the thickness of the ribbon is the corrosion resistance of the ribbon material verses the corrosion resistance of the secondary bag 42 material, as described above. The more resistant the material is to corrosion, the thinner the ribbon must be to meet the corrosion time requirements relative to the secondary bag 42, as discussed above. In the preferred embodiment, the thickness of the thinnest portion of the ribbon is in the range of from 1 mil to 100 mils.

The width of the ribbon must be small enough that it does not interfere with the dispersion of the liquid if the sprinkler head 14 is activated by heat or fire. Unlike the bags 42, 44, the preferred materials of the corrosion sensor 50 will not melt at a temperature below that of the activation temperature of the sprinkler head 14. Therefore, the upper limit on the ribbon width is defined by the amount of interference it presents to the liquid as it disperses. The lower limit to the ribbon width is defined by how easy the ribbon is to work with. The ribbon cannot be so thin that it cannot be easily assembled with the rest of the components of the shroud 40 without being damaged. In the preferred embodiment, the width of the ribbon is in the range of from ⅛ inch to ½ inch.

Figure 5:
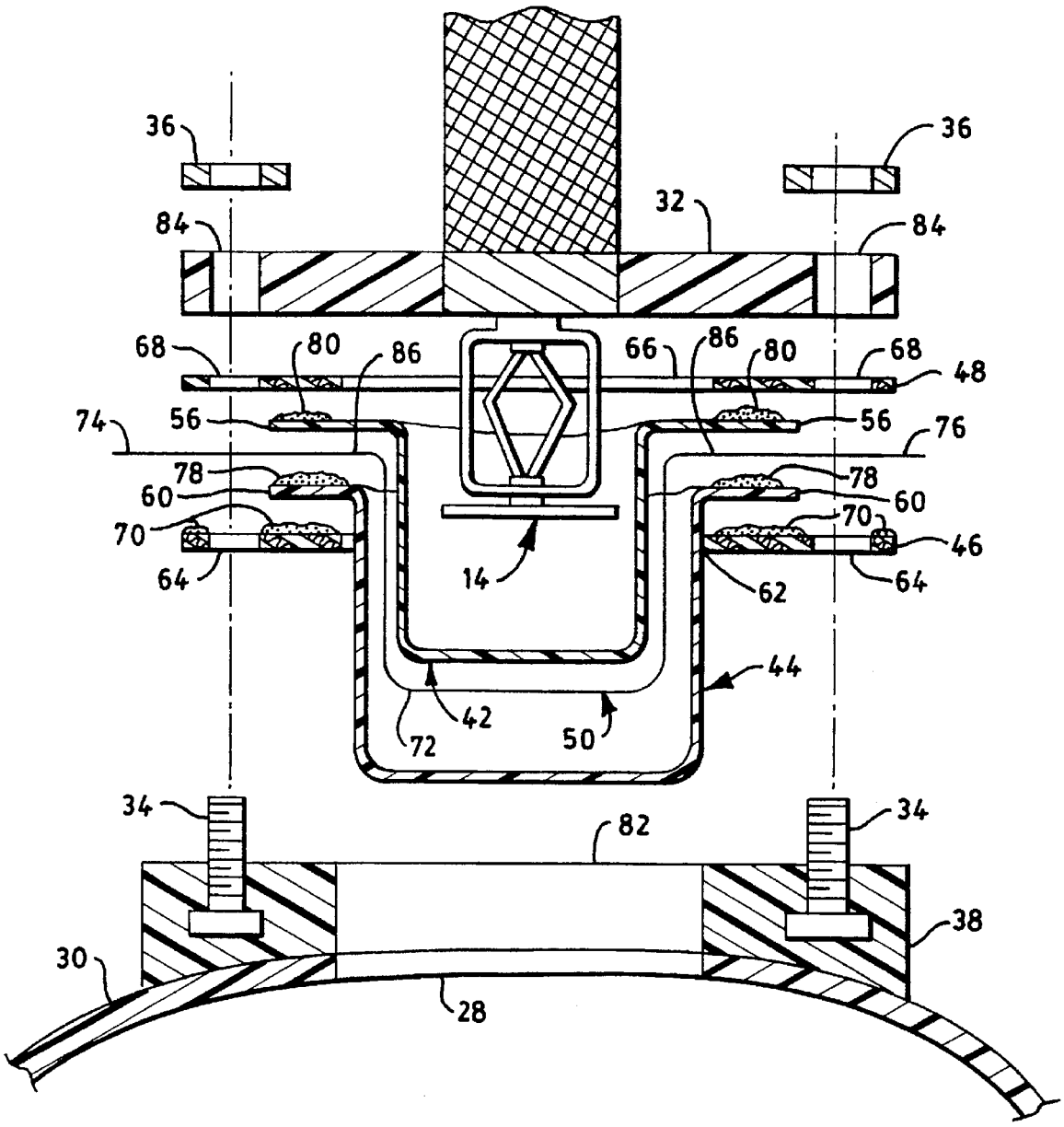
FIG. 5 is an exaggerated, exploded, cross-sectional view of the assembly of the preferred embodiment of the present invention.

As shown in FIG. 5, the preferred shroud 40 is assembled by first coating the upper surface of the lower gasket 46 with an adhesive 70, preferably a pressure-sensitive adhesive. The primary bag 44 is placed through the lower gasket bag hole 62 such that the primary bag skirt 60 rests on the adhesive 70. A portion of the center of the corrosion sensor 72 is formed into a U shape and inserted into the primary bag 44 such that the two ends of the corrosion sensor 74, 76 extend beyond the edge of the lower gasket 46. Optionally, the corrosion sensor U-shaped portion 72 is attached to the inside of the primary bag 44 by an adhesive. The upper surface of the primary bag skirt 60 is coated with an adhesive 78, preferably a pressure-sensitive adhesive, and the secondary bag 42 is inserted into the primary bag 44 until the secondary bag skirt 56 rests on the primary bag skirt 60 and on the corrosion sensor portions 86 adjacent to the U-shaped portion 72. The upper surface of the secondary bag skirt 56 is coated with an adhesive 80, preferably a pressure-sensitive adhesive, and the upper gasket 48 is placed on top of the secondary bag skirt 56 such that the gasket bag holes 62, 66 and the gasket mounting holes 64, 68 are aligned. The adhesive 70 on the upper surface of the lower gasket 46 binds the two gaskets 46, 48 together.

Using the sprinkler assembly example of FIG. 2, the shroud 40 is assembled to the sprinkler assembly by inserting the shroud 40 through the mounting block opening 82 and wall opening 28 such that the lower gasket 46 rests on the mounting block 38. The mounting plate 32 is placed over the bolts 34 so that the sprinkler head 14 resides inside the secondary bag 42. The nuts 36 are tightly turned onto the bolts 34 so that the combination of the gaskets 46, 48 and the adhesives 70, 78, 80 forms a substantially gas and vapor-tight seal between the mounting plate 32 and mounting block 38. After the sprinkler assembly is assembled, the corrosion sensor ends 74, 76 are attached to the detection circuit clips.

The shroud 40 is removed by reversing the order of assembly.

What is claimed is:

1. A shroud for use with a sprinkler assembly, said sprinkler assembly being operatively connected to a source of fluid and having a sprinkler head extending through an opening in a wall into a corrosive environment, said sprinkler head preventing said fluid from being dispersed at predetermined normal temperatures of said environment and allowing said fluid to be dispersed at a temperature above a predetermined elevated temperature of said environment, said shroud comprising:

(a) a secondary bag adapted to protect said sprinkler head from said corrosive environment for a predetermined minimum period of time;

(b) a corrosion sensor located adjacent to an outer surface of said secondary bag, said corrosion sensor triggering a detection circuit before said environment affects said secondary bag protection of said sprinkler head;

(c) a primary bag adapted to protect said secondary bag and said corrosion sensor from said corrosive environment for a predetermined minimum period of time; and (d) said primary bag and said secondary bag melting at a temperature that is higher than said normal temperatures and lower than said elevated temperature.

2. The shroud of claim 1 wherein said primary bag and said secondary bag are composed substantially of a material selected from the class consisting of polyethylene and polypropylene.

3. The shroud of claim 1 wherein:

(a) said secondary bag has a secondary bag opening and an annular skirt extending perpendicularly from the edge of said secondary bag opening;

(b) said primary bag has a primary bag opening approximately the same size and shape as said secondary bag opening and an annular skirt extending perpendicularly from the edge of said primary bag opening;

(c) said shroud includes a lower gasket having a lower gasket opening approximately the same size and shape as said secondary bag opening;

(d) said shroud includes an upper gasket having an upper gasket opening approximately the same size and shape as said secondary bag opening;

(e) said primary bag extending through said lower gasket opening, said primary bag skirt being adhesively attached to said lower gasket about substantially the entire circumference of said lower gasket opening;

(f) said corrosion sensor extending into said primary bag;

(g) said secondary bag extending into said primary bag, said secondary bag skirt being adhesively attached to said primary bag skirt about substantially the entire circumference of said primary bag skirt; and (h) said upper gasket located such that said primary bag skirt and said secondary bag skirt are between said lower gasket and said upper gasket, said upper gasket opening being aligned with said lower gasket opening and said upper gasket being adhesively attached to said lower gasket about substantially the entire surface of said lower gasket and to said secondary bag skirt about substantially the entire circumference of said secondary bag skirt.

4. The shroud of claim 3 wherein said adhesives are pressure-sensitive.

5. The shroud of claim 3 wherein said sprinkler assembly is secured to said wall by a plurality of bolt/nut combinations and said lower gasket and said upper gasket have a plurality of aligned mounting hole pairs, each of said mounting hole pairs being aligned with one of said bolts, whereby said shroud is secured by said bolt/nut combinations.

6. The shroud of claim 3 wherein said lower gasket and said upper gasket are composed substantially of an ethylene propylene diene monomer.

7. The shroud of claim 1 wherein said corrosion sensor is an electrically-conductive ribbon having at least two ends removably connected to said detection circuit and a center portion that corrodes apart to trigger said detection circuit.

8. The shroud of claim 7 wherein said center portion has a thickness in the range of from 1 mil to 100 mils and a width in the range of from ⅛ inch to ½ inch.

9. The shroud of claim 7 wherein said center portion is composed substantially of a material selected from the class consisting of copper and aluminum.

10. A shroud for use with a sprinkler assembly, said sprinkler assembly being operatively connected to a source of fluid and having a sprinkler head extending through an opening in a wall into a corrosive environment, said sprinkler head preventing said fluid from being dispersed at predetermined normal temperatures of said environment and allowing said fluid to be dispersed at a temperature above a predetermined elevated temperature of said environment, said shroud comprising:

(a) a secondary bag adapted to protect said sprinkler head from said corrosive environment for a predetermined minimum period of time, said secondary bag having a secondary bag opening and an annular skirt extending perpendicularly from the edge of said secondary bag opening;

(b) a corrosion sensor located adjacent to an outer surface of said secondary bag, said corrosion sensor being an electrically-conductive ribbon having a center portion that corrodes apart and triggers a detection circuit before said environment affects said secondary bag protection of said sprinkler head, and having at least two ends removably connected to said detection circuit;

(c) a primary bag adapted to protect said secondary bag and said corrosion sensor from said corrosive environment for a predetermined minimum period of time, said primary bag having a primary bag opening approximately the same size and shape as said secondary bag opening and an annular skirt extending perpendicularly from the edge of said primary bag opening;

(d) a lower gasket having a lower gasket opening approximately the same size and shape as said primary bag opening;

(e) an upper gasket having an upper gasket opening approximately the same size and shape as said lower gasket opening;

(f) said primary bag extending through said lower gasket opening, said primary bag skirt being adhesively attached to said lower gasket about substantially the entire circumference of said lower gasket opening;

(g) said corrosion sensor extending into said primary bag;

(h) said secondary bag extending into said primary bag, said secondary bag skirt being adhesively attached to said primary bag skirt about substantially the entire circumference of said primary bag skirt;

(i) said upper gasket located such that said primary bag skirt and said secondary bag skirt are between said lower gasket and said upper gasket, said upper gasket opening being aligned with said lower gasket opening and said upper gasket being adhesively attached to said lower gasket about substantially the entire surface of said lower gasket and to said secondary bag skirt about substantially the entire circumference of said secondary bag skirt; and (j) said primary bag and said secondary bag melting at a temperature that is higher than said normal temperatures and lower than said elevated temperature.

11. The shroud of claim 10 wherein said primary bag and said secondary bag are composed substantially of a material selected from the class consisting of polyethylene and polypropylene.

12. The shroud of claim 10 wherein said adhesives are pressure-sensitive.

13. The shroud of claim 10 wherein said sprinkler assembly is secured to said wall by a plurality of bolt/nut combinations and said lower gasket and said upper gasket have a plurality of aligned mounting hole pairs, each of said mounting hole pairs being aligned with one of said bolts, whereby said shroud is secured by said bolt/nut combinations.

14. The shroud of claim 10 wherein said lower gasket and said upper gasket are composed substantially of an ethylene propylene diene monomer.

15. The shroud of claim 10 wherein said center portion has a thickness in the range of from 1 mil to 100 mils and a width in the range of from ⅛ inch to ½ inch.

16. The shroud of claim 10 wherein said center portion is composed substantially of a material selected from the class consisting of copper and aluminum.

17. A shroud for use with a sprinkler assembly, said sprinkler assembly being operatively connected to a source of fluid and having a sprinkler head extending through an opening in a wall into a corrosive environment, said sprinkler head preventing said fluid from being dispersed at predetermined normal temperatures of said environment and allowing said fluid to be dispersed at a temperature above a predetermined elevated temperature of said environment, said shroud comprising:

(a) a secondary bag adapted to protect said sprinkler head from said corrosive environment for a predetermined minimum period of time, said secondary bag having a secondary bag opening and an annular skirt extending perpendicularly from the edge of said secondary bag opening;

(b) a corrosion sensor located adjacent to an outer surface of said secondary bag, said corrosion sensor being an electrically-conductive ribbon having a center portion that corrodes apart and triggers a detection circuit before said environment affects said secondary bag protection of said sprinkler head, and having at least two ends removably connected to said detection circuit, said center portion being composed substantially of a material selected from the class consisting of copper and aluminum and having a thickness in the range of from 1 mil to 100 mils and a width in the range of from ⅛ inch to ½ inch;

(c) a primary bag adapted to prevent said secondary bag and said corrosion sensor from said corrosive environment for a predetermined minimum period of time, said primary bag having a primary bag opening approximately the same size and shape as said secondary bag opening and an annular skirt extending perpendicularly from the edge of said primary bag opening;

(d) a lower gasket having a lower gasket opening approximately the same size and shape as said primary bag opening;

(e) an upper gasket having an upper gasket opening approximately the same size and shape as said lower gasket opening;

(f) said primary bag extending through said lower gasket opening, said primary bag skirt being adhesively attached to said lower gasket about substantially the entire circumference of said lower gasket opening;

(g) said corrosion sensor extending into said primary bag;

(h) said secondary bag extending into said primary bag, said secondary bag skirt being adhesively attached to said primary bag skirt about substantially the entire circumference of said primary bag skirt;

(i) said upper gasket located such that said primary bag skirt and said secondary bag skirt are between said lower gasket and said upper gasket, said upper gasket opening being aligned with said lower gasket opening and said upper gasket being adhesively attached to said lower gasket about substantially the entire surface of said lower gasket and to said secondary bag skirt about substantially the entire circumference of said secondary bag skirt;

(j) said adhesives being pressure-sensitive;

(k) said primary bag and said secondary bag being composed substantially of a material selected from the class consisting of polyethylene and polypropylene, and melting at a temperature that is higher than said normal temperatures and lower than said elevated temperature; and (l) said lower gasket and said upper gasket being composed substantially of an ethylene propylene diene monomer.

18. The shroud of claim 17 wherein said sprinkler assembly is secured to said wall by a plurality of bolt/nut combinations and said lower gasket and said upper gasket have a plurality of aligned mounting hole pairs, each of said mounting hole pairs being aligned with one of said bolts, whereby said shroud is secured by said bolt/nut combinations.

19. In a sprinkler system having fluid distribution, a grid of pipes operatively feeding therefrom, a plurality of sprinkler assemblies having operative connections thereto, each of said sprinkler assemblies having a sprinkler head extending through an opening in a wall into a corrosive environment, said sprinkler head preventing said fluid from being dispersed at predetermined normal temperatures of said environment and allowing said fluid to be dispersed at a temperature above a predetermined elevated temperature of said environment, a shroud comprising:

(a) a secondary bag adapted to protect said sprinkler head from said corrosive environment for a predetermined minimum period of time, said secondary bag having a secondary bag opening and an annular skirt extending perpendicularly from the edge of said secondary bag opening;

(b) a corrosion sensor located adjacent to an outer surface of said secondary bag, said corrosion sensor being an electrically-conductive ribbon having a center portion that corrodes apart and triggers a detection circuit before said environment affects said secondary bag protection of said sprinkler head, and having at least two ends removably connected to said detection circuit;

(c) a primary bag adapted to protect said secondary bag and said corrosion sensor from said corrosive environment for a predetermined minimum period of time, said primary bag having a primary bag opening approximately the same size and shape as said secondary bag opening and an annular skirt extending perpendicularly from the edge of said primary bag opening;

(d) a lower gasket having a lower gasket opening approximately the same size and shape as said primary bag opening;

(e) an upper gasket having an upper gasket opening approximately the same size and shape as said lower gasket opening;

(f) said primary bag extending through said lower gasket opening, said primary bag skirt being adhesively attached to said lower gasket about substantially the entire circumference of said lower gasket opening;

(g) said corrosion sensor extending into said primary bag;

(h) said secondary bag extending into said primary bag, said secondary bag skirt being adhesively attached to said primary bag skirt about substantially the entire circumference of said primary bag skirt;

(i) said upper gasket located such that said primary bag skirt and said secondary bag skirt are between said lower gasket and said upper gasket, said upper gasket opening being aligned with said lower gasket opening and said upper gasket being adhesively attached to said lower gasket about substantially the entire surface of said lower gasket and to said secondary bag skirt about substantially the entire circumference of said secondary bag skirt; and (j) said primary bag and said secondary bag melting at a temperature that is higher than said normal temperatures and lower than said elevated temperature.

20. The shroud of claim 19 wherein said primary bag and said secondary bag are composed substantially of a material selected from the class consisting of polyethylene and polypropylene.

21. The shroud of claim 19 wherein said adhesives are pressure-sensitive.

22. The shroud of claim 19 wherein said sprinkler assembly is secured to said wall by a plurality of bolt/nut combinations and said lower gasket and said upper gasket have a plurality of aligned mounting hole pairs, each of said mounting hole pairs being aligned with one of said bolts, whereby said shroud is secured by said bolt/nut combinations.

23. The shroud of claim 19 wherein said lower gasket and said upper gasket are composed substantially of an ethylene propylene diene monomer.

24. The shroud of claim 19 wherein said center portion has a thickness in the range of from 1 mil to 100 mils and a width in the range of from ⅛ inch to ½ inch.

25. The shroud of claim 19 wherein said center portion is composed substantially of a material selected from the class consisting of copper and aluminum.

26. In a sprinkler system having fluid distribution, a grid of pipes operatively feeding therefrom, a plurality of sprinkler assemblies having operative connections thereto, each of said sprinkler assemblies having a sprinkler head extending through an opening in a wall into a corrosive environment, said sprinkler head preventing said fluid from being dispersed at predetermined normal temperatures of said environment and allowing said fluid to be dispersed at a temperature above a predetermined elevated temperature of said environment, a shroud comprising:

(a) a secondary bag adapted to protect said sprinkler head from said corrosive environment for a predetermined minimum period of time, said secondary bag having a secondary bag opening and an annular skirt extending perpendicularly from the edge of said secondary bag opening;

(b) a corrosion sensor located adjacent to an outer surface of said secondary bag, said corrosion sensor being an electrically-conductive ribbon having a center portion that corrodes apart and triggers a detection circuit before said environment affects said secondary bag protection of said sprinkler head, and having at least two ends removably connected to said detection circuit, said center portion being composed substantially of a material selected from the class consisting of copper and aluminum and having a thickness in the range of from 1 mil to 100 mils and a width in the range of from ⅛ inch to ½ inch;

(c) a primary bag adapted to protect said secondary bag and said corrosion sensor from said corrosive environment for a predetermined minimum period of time, said primary bag having a primary bag opening approximately the same size and shape as said secondary bag opening and an annular skirt extending perpendicularly from the edge of said primary bag opening;

(d) a lower gasket having a lower gasket opening approximately the same size and shape as said primary bag opening;

(e) an upper gasket having an upper gasket opening approximately the same size and shape as said lower gasket opening;

(f) said primary bag extending through said lower gasket opening, said primary bag skirt being adhesively attached to said lower gasket about substantially the entire circumference of said lower gasket opening;

(g) said corrosion sensor extending into said primary bag;

(h) said secondary bag extending into said primary bag, said secondary bag skirt being adhesively attached to said primary bag skirt about substantially the entire circumference of said primary bag skirt;

(i) said upper gasket located such that said primary bag skirt and said secondary bag skirt are between said lower gasket and said upper gasket, said upper gasket opening being aligned with said lower gasket opening and said upper gasket being adhesively attached to said lower gasket about substantially the entire surface of said lower gasket and to said secondary bag skirt about substantially the entire circumference of said secondary bag skirt;

(j) said adhesives being pressure-sensitive;

(k) said primary bag and said secondary bag being composed substantially of a material selected from the class consisting of polyethylene and polypropylene, and melting at a temperature that is higher than said normal temperatures and lower than said elevated temperature; and (l) said lower gasket and said upper gasket being composed substantially of an ethylene propylene diene monomer.

27. The shroud of claim 26 wherein said sprinkler assembly is secured to said wall by a plurality of bolt/nut combinations and said lower gasket and said upper gasket have a plurality of aligned mounting hole pairs, each of said mounting hole pairs being aligned with one of said bolts, whereby said shroud is secured by said bolt/nut combinations.

* * * * *